US011530505B2

(12) United States Patent
Scheckelhoff et al.

(10) Patent No.: US 11,530,505 B2
(45) Date of Patent: Dec. 20, 2022

(54) SYSTEM AND METHOD FOR DETECTING AN ELEVATED DRAIN FOR A WASHING MACHINE APPLIANCE

(71) Applicant: Haier US Appliance Solutions, Inc., Wilmington, DE (US)

(72) Inventors: Ryan James Scheckelhoff, Louisville, KY (US); Ryan Ellis Leonard, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 83 days.

(21) Appl. No.: 16/931,597

(22) Filed: Jul. 17, 2020

(65) Prior Publication Data

US 2022/0018052 A1 Jan. 20, 2022

(51) Int. Cl.

| | |
|---|---|
| ***D06F 33/42*** | (2020.01) |
| ***D06F 23/02*** | (2006.01) |
| ***D06F 39/08*** | (2006.01) |
| ***D06F 103/14*** | (2020.01) |
| ***D06F 105/02*** | (2020.01) |

(Continued)

(52) U.S. Cl.

CPC ..... *D06F 33/42* (2020.02); *D06F 23/02* (2013.01); *D06F 39/083* (2013.01); *D06F 39/087* (2013.01); *D06F 2103/04* (2020.02); *D06F 2103/14* (2020.02); *D06F 2103/18* (2020.02); *D06F 2105/02* (2020.02); *D06F 2105/08* (2020.02)

(58) Field of Classification Search

CPC ... D06F 33/42; D06F 2103/14; D06F 2105/08

See application file for complete search history.

(56) References Cited

U.S. PATENT DOCUMENTS 3,242,703 A * 3/1966 Brundage ..... D06F 37/308 210/368
4,321,809 A * 3/1982 Bochan ..... D06F 39/087 68/207

(Continued)

FOREIGN PATENT DOCUMENTS

EP 0332893 A2 * 9/1989
EP 2754745 A2 * 7/2014 ..... D06F 33/02

OTHER PUBLICATIONS

EP2754745A2 Machine Translation (Year: 2014).*

*Primary Examiner* — Spencer E. Bell

(74) *Attorney, Agent, or Firm* — Dority & Manning, P.A.

(57) ABSTRACT

A washing machine appliance includes a sump for collecting wash fluid, a supply valve for supplying the wash fluid, a drain assembly for discharging the wash fluid from the sump, and a water level detection system for measuring sump pressures/fill levels. A controller is configured to perform an initial fill cycle and determine a first volume of wash fluid required to reach a target pressure. The drain assembly then drains the sump and the process is repeated to determine a second volume of wash fluid required to reach the target pressure. The difference between the first volume and the second volume is at least partially a result of wash fluid that the drain assembly could not discharge through the drain hose. The controller may determine that the external drain is elevated, and compensate accordingly, if a difference between the first volume and the second volume exceeds a predetermined threshold.

16 Claims, 5 Drawing Sheets

(51) Int. Cl.

| | |
|---|---|
| ***D06F 105/08*** | (2020.01) |
| ***D06F 103/04*** | (2020.01) |
| ***D06F 103/18*** | (2020.01) |

(56) References Cited

U.S. PATENT DOCUMENTS

| | | | | |
|---|---|---|---|---|
| 4,418,712 | A | 12/1983 | Braley | |
| 7,810,362 | B2 | 10/2010 | Harwood | |
| 2019/0127903 | A1 | 5/2019 | Je | |
| 2020/0040505 | A1* | 2/2020 | Jang | D06F 37/40 |
| 2022/0010477 | A1* | 1/2022 | Perosa | D06F 39/085 |

* cited by examiner

SYSTEM AND METHOD FOR DETECTING AN ELEVATED DRAIN FOR A WASHING MACHINE APPLIANCE

FIELD OF THE INVENTION

The present subject matter relates generally to washing machine appliances, or more specifically, to methods for detecting an elevated external drain and compensate for such an elevated external drain during operation of a washing machine appliance.

BACKGROUND OF THE INVENTION

Washing machine appliances generally include a tub for containing water or wash fluid, e.g., water and detergent, bleach, and/or other wash additives. A basket is rotatably mounted within the tub and defines a wash chamber for receipt of articles for washing. During normal operation of such washing machine appliances, the wash fluid is directed into the tub and onto articles within the wash chamber of the basket. The basket or an agitation element can rotate at various speeds to agitate articles within the wash chamber, to wring wash fluid from articles within the wash chamber, etc. During a spin or drain cycle, a drain assembly may operate to discharge water from within sump.

Conventional drain pump assemblies include a drain hose that provides fluid communication between the sump and an external drain. A drain pump is fluidly coupled to the drain hose for discharging wash fluid from the sump during a drain cycle. Notably, however, in the event of a particularly lengthy drain hose or an elevated standpipe or external drain, the drain pump is not capable of discharging all wash fluid to the external drain, e.g., due to loss of pump prime. As a result, residual wash fluid remaining within the drain hose and tends to flow back into the sump. Failure to compensate for this extra amount of wash fluid may result in overfilling the wash tub or providing a sub-optimal amount of wash fluid for a particular cycle.

Accordingly, a washing machine appliance having improved water level detection systems would be desirable. More specifically, a water level detection system with a method for detecting an elevated external drain or standpipe would be particularly beneficial.

BRIEF DESCRIPTION OF THE INVENTION

Advantages of the invention will be set forth in part in the following description, or may be apparent from the description, or may be learned through practice of the invention.

In one aspect of the present disclosure, a washing machine appliance is provided including a sump for collecting wash fluid, a supply valve for providing the wash fluid into the sump, a drain assembly including a drain hose that fluidly couples the sump to an external drain for discharging the wash fluid through the external drain, and a water level detection system including a pressure sensor fluidly coupled to the sump. A controller is operably coupled to the supply valve, the drain assembly, and the water level detection system, the controller being configured to: measure a sump pressure using the water level detection system; operate the supply valve to provide a first volume of the wash fluid into the sump such that the sump pressure reaches a target pressure; operate the drain assembly to drain the wash fluid from the sump; operate the supply valve to provide a second volume of the wash fluid into the sump such that the sump pressure reaches the target pressure; and determine that the external drain is elevated based at least in part on a difference between the first volume and the second volume.

In another aspect of the present disclosure, a method for operating a washing machine appliance is provided. The washing machine appliance includes a sump for collecting wash fluid, a supply valve for providing the wash fluid into the sump, a drain assembly including a drain hose for discharging the wash fluid through an external drain, and a water level detection system for measuring a sump pressure. The method includes measuring a sump pressure using the water level detection system, operating the supply valve to provide a first volume of the wash fluid into the sump such that the sump pressure reaches a target pressure, operating the drain assembly to drain the wash fluid from the sump, operating the supply valve to provide a second volume of the wash fluid into the sump such that the sump pressure reaches the target pressure, and determining that the external drain is elevated based at least in part on a difference between the first volume and the second volume.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
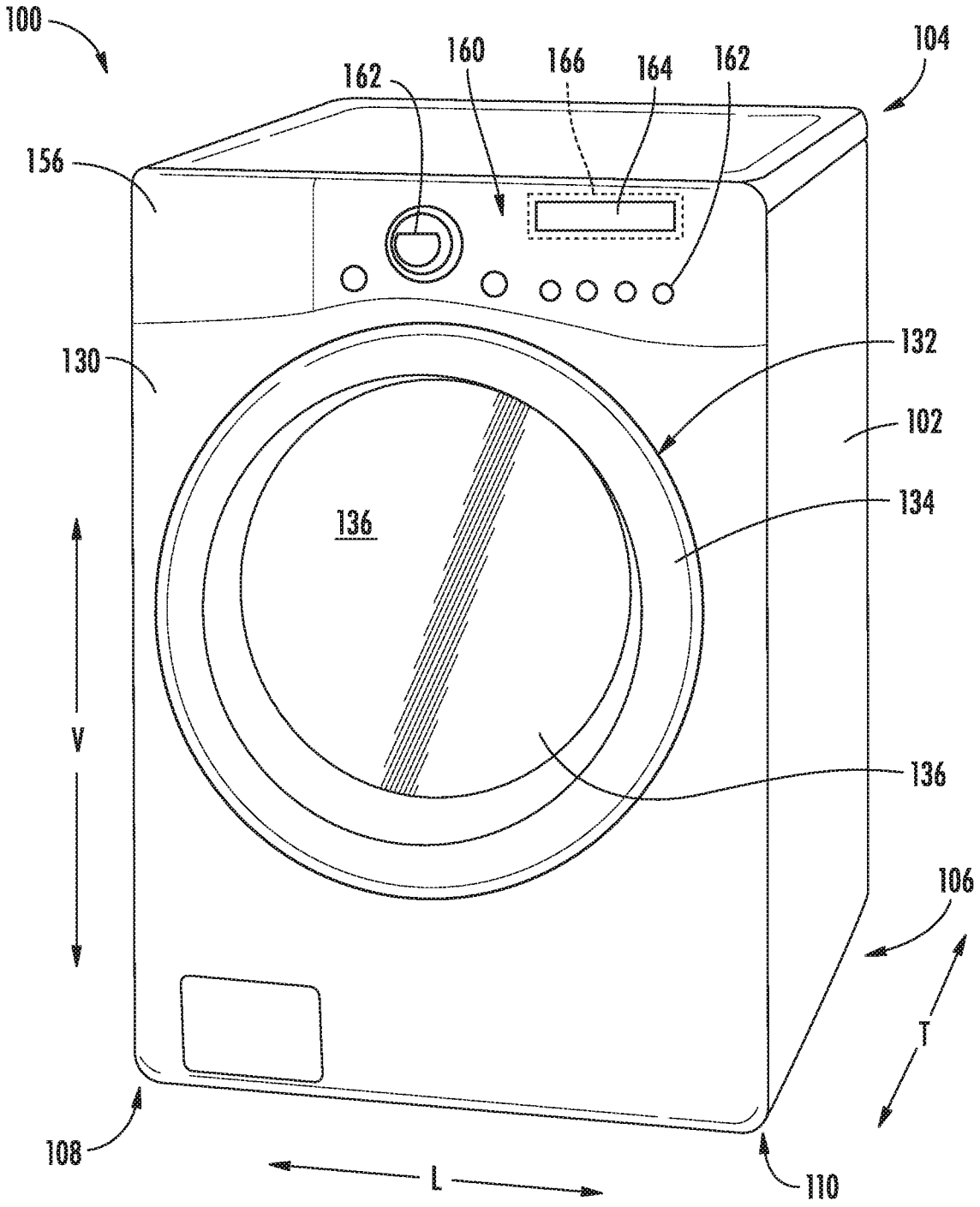
FIG. 1 provides a perspective view of an exemplary washing machine appliance according to an exemplary embodiment of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "includes" and "including" are intended to be inclusive in a manner similar to the term "comprising." Similarly, the term "or" is generally intended to be inclusive (i.e., "A or B" is intended to mean "A or B or both"). Approximating language, as used herein throughout the specification and claims, is applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. For example, the approximating language may refer to being within a 10 percent margin.

Figure 2:
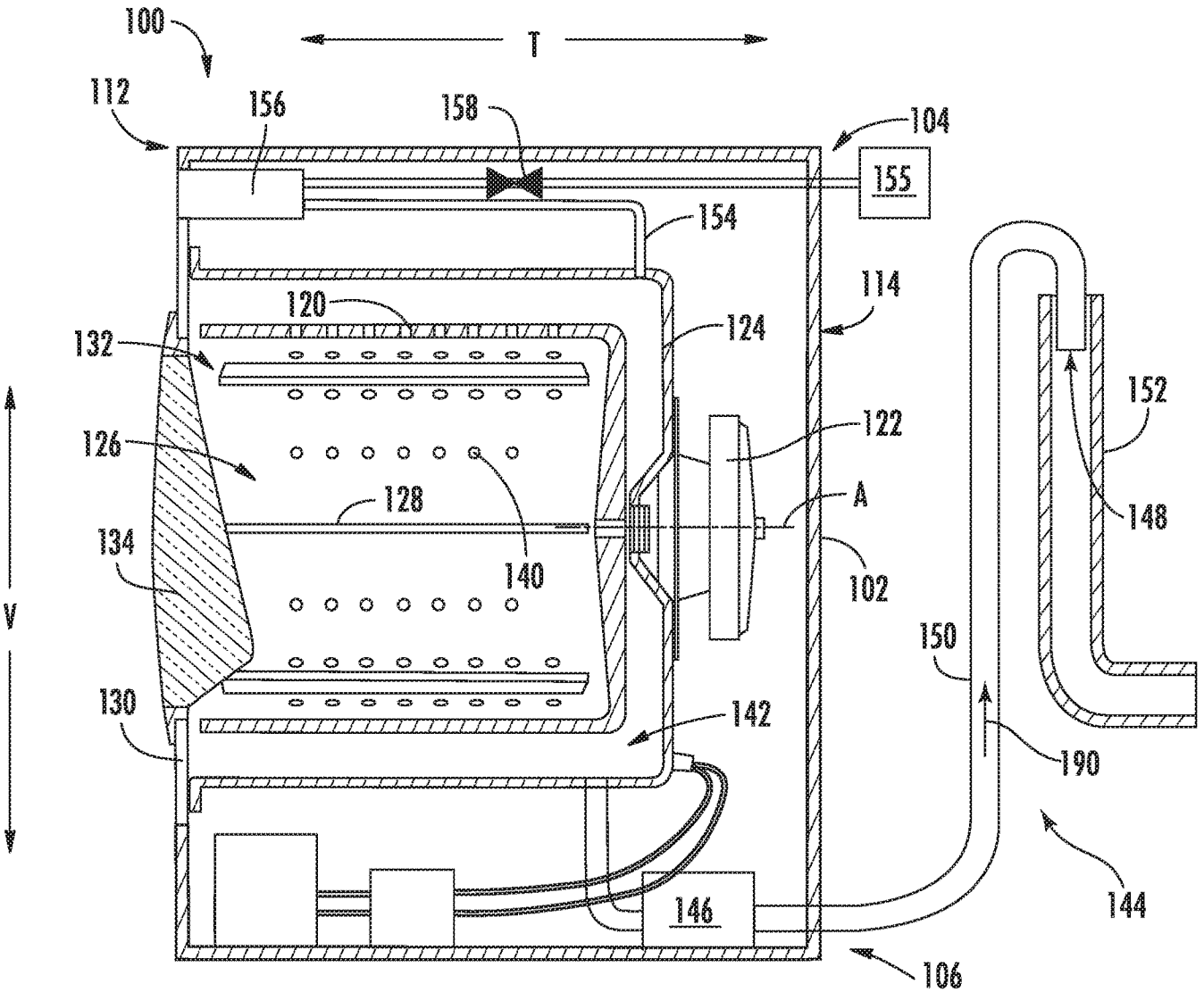
FIG. 2 provides a side cross-sectional view of the exemplary washing machine appliance of FIG. 1.

Referring now to the figures, FIG. 1 is a perspective view of an exemplary horizontal axis washing machine appliance 100 and FIG. 2 is a side cross-sectional view of washing machine appliance 100. As illustrated, washing machine appliance 100 generally defines a vertical direction V, a lateral direction L, and a transverse direction T, each of which is mutually perpendicular, such that an orthogonal coordinate system is generally defined. Washing machine appliance 100 includes a cabinet 102 that extends between a top 104 and a bottom 106 along the vertical direction V, between a left side 108 and a right side 110 along the lateral direction, and between a front 112 and a rear 114 along the transverse direction T.

Referring to FIG. 2, a wash basket 120 is rotatably mounted within cabinet 102 such that it is rotatable about an axis of rotation A. A motor 122, e.g., such as a pancake motor, is in mechanical communication with wash basket 120 to selectively rotate wash basket 120 (e.g., during an agitation or a rinse cycle of washing machine appliance 100). Wash basket 120 is received within a wash tub 124 and defines a wash chamber 126 that is configured for receipt of articles for washing. The wash tub 124 holds wash and rinse fluids for agitation in wash basket 120 within wash tub 124. As used herein, "wash fluid" may refer to water, detergent, fabric softener, bleach, or any other suitable wash additive or combination thereof. Indeed, for simplicity of discussion, these terms may all be used interchangeably herein without limiting the present subject matter to any particular "wash fluid."

Wash basket 120 may define one or more agitator features that extend into wash chamber 126 to assist in agitation and cleaning articles disposed within wash chamber 126 during operation of washing machine appliance 100. For example, as illustrated in FIG. 2, a plurality of ribs 128 extends from basket 120 into wash chamber 126. In this manner, for example, ribs 128 may lift articles disposed in wash basket 120 during rotation of wash basket 120.

Referring generally to FIGS. 1 and 2, cabinet 102 also includes a front panel 130 which defines an opening 132 that permits user access to wash basket 120 of wash tub 124. More specifically, washing machine appliance 100 includes a door 134 that is positioned over opening 132 and is rotatably mounted to front panel 130. In this manner, door 134 permits selective access to opening 132 by being movable between an open position (not shown) facilitating access to a wash tub 124 and a closed position (FIG. 1) prohibiting access to wash tub 124.

A window 136 in door 134 permits viewing of wash basket 120 when door 134 is in the closed position, e.g., during operation of washing machine appliance 100. Door 134 also includes a handle (not shown) that, e.g., a user may pull when opening and closing door 134. Further, although door 134 is illustrated as mounted to front panel 130, it should be appreciated that door 134 may be mounted to another side of cabinet 102 or any other suitable support according to alternative embodiments.

Referring again to FIG. 2, wash basket 120 also defines a plurality of perforations 140 in order to facilitate fluid communication between an interior of basket 120 and wash tub 124. A sump 142 is defined by wash tub 124 at a bottom of wash tub 124 along the vertical direction V. Thus, sump 142 is configured for receipt of and generally collects wash fluid during operation of washing machine appliance 100. For example, during operation of washing machine appliance 100, wash fluid may be urged by gravity from basket 120 to sump 142 through plurality of perforations 140.

A drain assembly 144 is located beneath wash tub 124 and is in fluid communication with sump 142 for periodically discharging soiled wash fluid from washing machine appliance 100. Drain assembly 144 may generally include a drain pump 146 which is in fluid communication with sump 142 and with an external drain 148 through a drain hose 150. As best shown in FIG. 2, external drain 148 may be positioned within a distal end of a standpipe 152, e.g., that may be mounted within a wall of the structure where the washing machine appliance 100 is mounted. Such standpipes 152 may be positioned above an overflow level of washing machine appliance 100, e.g., to prevent overflow during a drain cycle. During a drain cycle, drain pump 146 urges a flow of wash fluid from sump 142, through drain hose 150, to external drain 148, where the wash fluid drains through standpipe 152. More specifically, drain pump 146 includes a motor (not shown) which is energized during a drain cycle such that drain pump 146 draws wash fluid from sump 142 and urges it through drain hose 150 to external drain 148.

A spout 154 is configured for directing a flow of fluid into wash tub 124. For example, spout 154 may be in fluid communication with a water supply 155 (FIG. 2) in order to direct fluid (e.g., clean water or wash fluid) into wash tub 124. Spout 154 may also be in fluid communication with the sump 142. For example, pump assembly 144 may direct wash fluid disposed in sump 142 to spout 154 in order to circulate wash fluid in wash tub 124.

As illustrated in FIG. 2, a detergent drawer 156 is slidably mounted within front panel 130. Detergent drawer 156 receives a wash additive (e.g., detergent, fabric softener, bleach, or any other suitable liquid or powder) and directs the fluid additive to wash tub 124 during operation of washing machine appliance 100. According to the illustrated embodiment, detergent drawer 156 may also be fluidly coupled to spout 154 to facilitate the complete and accurate dispensing of wash additive.

In addition, a water supply valve 158 may provide a flow of water from a water supply source (such as a municipal water supply 155) into detergent dispenser 156 and into wash tub 124. In this manner, water supply valve 158 may generally be operable to supply water into detergent dispenser 156 to generate a wash fluid, e.g., for use in a wash cycle, or a flow of fresh water, e.g., for a rinse cycle. It should be appreciated that water supply valve 158 may be positioned at any other suitable location within cabinet 102. In addition, although water supply valve 158 is described herein as regulating the flow of "wash fluid," it should be appreciated that this term includes, water, detergent, other additives, or some mixture thereof.

A control panel 160 including a plurality of input selectors 162 is coupled to front panel 130. Control panel 160 and input selectors 162 collectively form a user interface input for operator selection of machine cycles and features. For example, in one embodiment, a display 164 indicates selected features, a countdown timer, and/or other items of interest to machine users.

Operation of washing machine appliance 100 is controlled by a controller or processing device 166 (FIG. 1) that is operatively coupled to control panel 160 for user manipulation to select washing machine cycles and features. In response to user manipulation of control panel 160, controller 166 operates the various components of washing machine appliance 100 to execute selected machine cycles and features.

Controller 166 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 166 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 160 and other components of washing machine appliance 100 may be in communication with controller 166 via one or more signal lines or shared communication busses.

During operation of washing machine appliance 100, laundry items are loaded into wash basket 120 through opening 132, and washing operation is initiated through operator manipulation of input selectors 162. Wash tub 124 is filled with water, detergent, and/or other fluid additives, e.g., via spout 154 and or detergent drawer 156. One or more valves (e.g., water supply valve 158) can be controlled by washing machine appliance 100 to provide for filling wash basket 120 to the appropriate level for the amount of articles being washed and/or rinsed. By way of example for a wash mode, once wash basket 120 is properly filled with fluid, the contents of wash basket 120 can be agitated (e.g., with ribs 128) for washing of laundry items in wash basket 120.

After the agitation phase of the wash cycle is completed, wash tub 124 can be drained. Laundry articles can then be rinsed by again adding fluid to wash tub 124, depending on the particulars of the cleaning cycle selected by a user. Ribs 128 may again provide agitation within wash basket 120. One or more spin cycles may also be used. In particular, a spin cycle may be applied after the wash cycle and/or after the rinse cycle in order to wring wash fluid from the articles being washed. During a final spin cycle, basket 120 is rotated at relatively high speeds and drain assembly 144 may discharge wash fluid from sump 142. After articles disposed in wash basket 120 are cleaned, washed, and/or rinsed, the user can remove the articles from wash basket 120, e.g., by opening door 134 and reaching into wash basket 120 through opening 132.

While described in the context of a specific embodiment of horizontal axis washing machine appliance 100, using the teachings disclosed herein it will be understood that horizontal axis washing machine appliance 100 is provided by way of example only. Other washing machine appliances having different configurations, different appearances, and/or different features may also be utilized with the present subject matter as well, e.g., vertical axis washing machine appliances.

Figure 3:
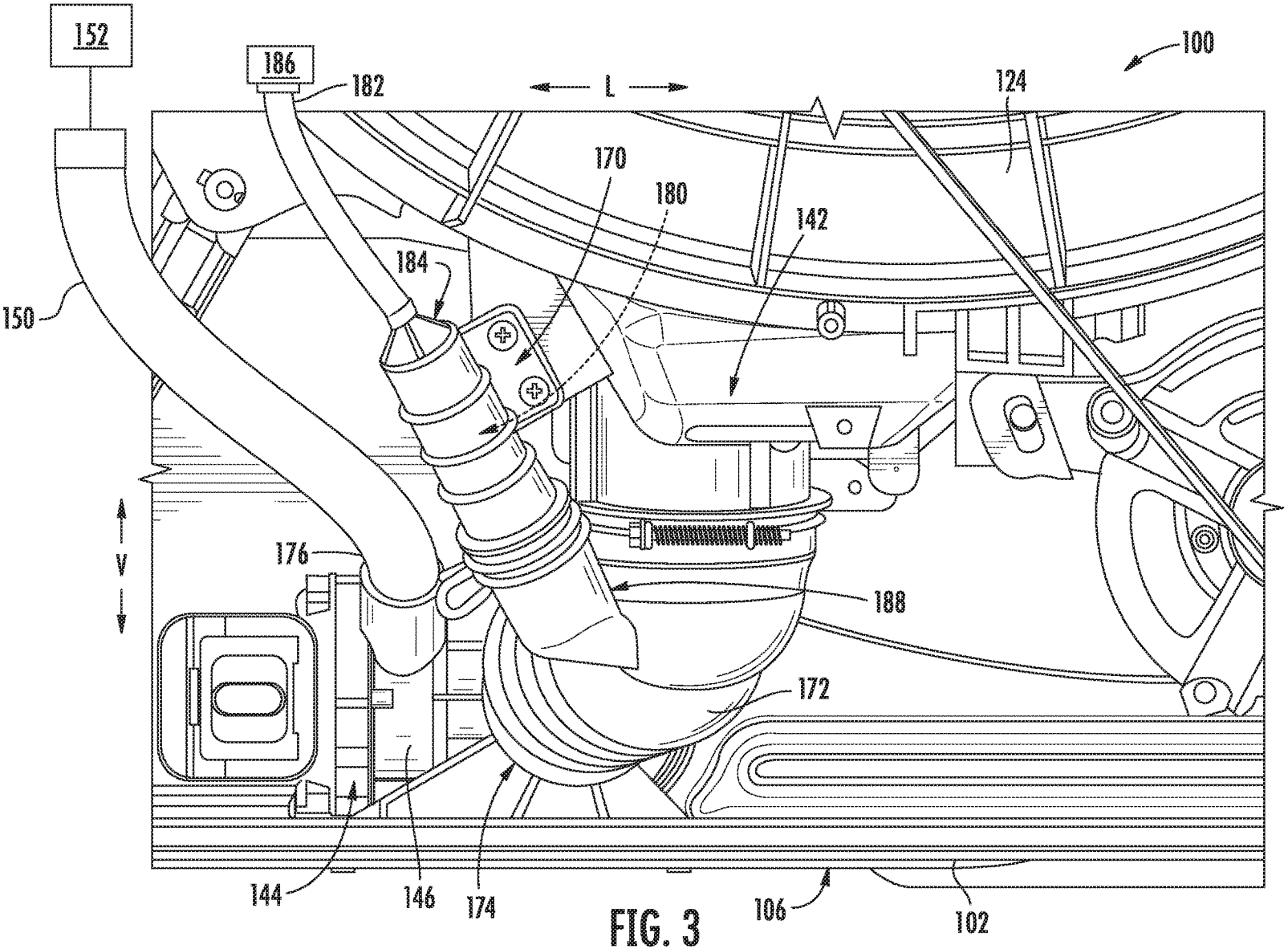
FIG. 3 provides a rear, perspective view of a drain assembly and a water level detection system according to an exemplary embodiment of the present subject matter.
Figure 4:
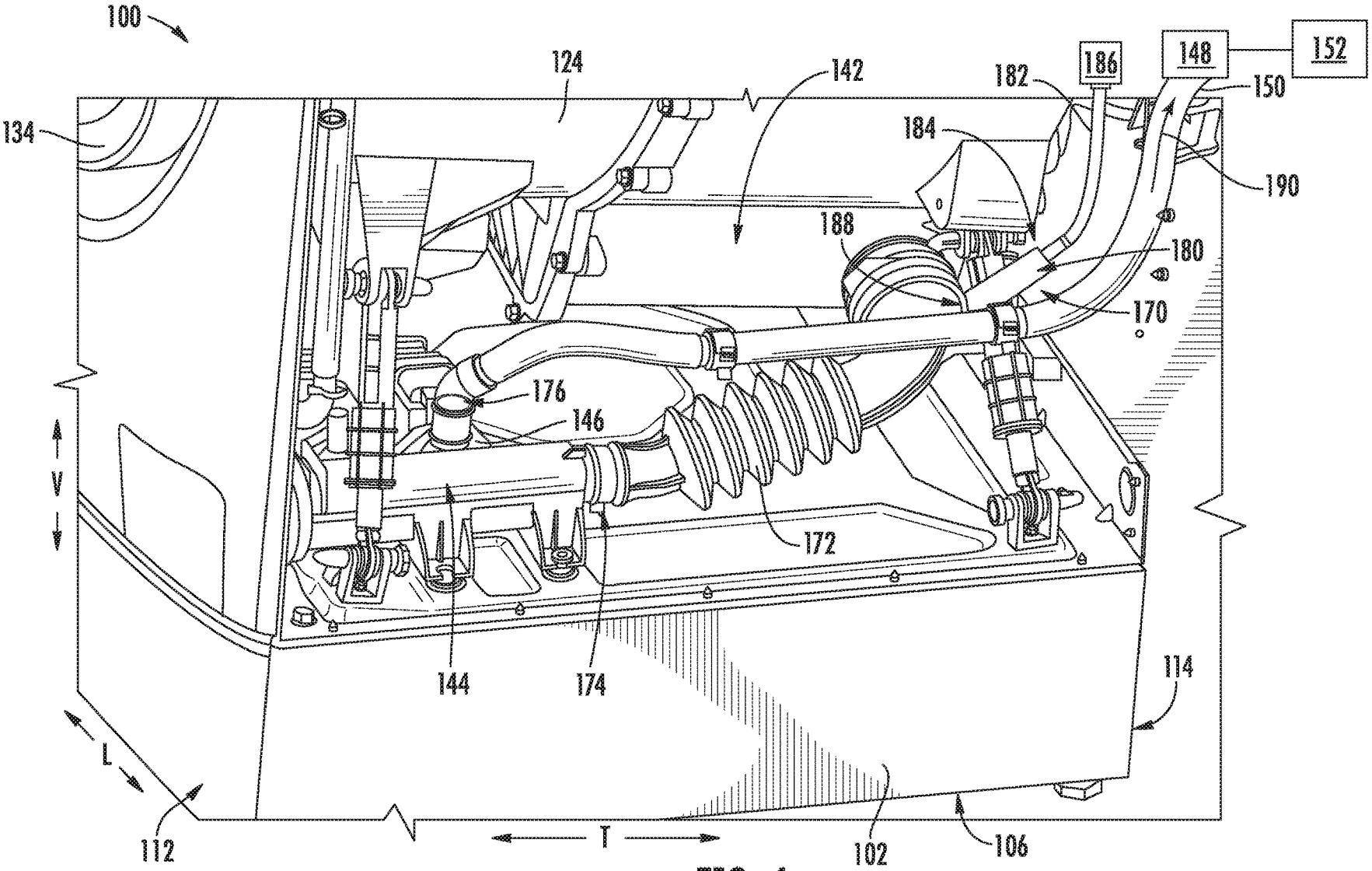
FIG. 4 provides a side, perspective view of the exemplary drain assembly and water level detection system of FIG. 3.

Referring now to FIGS. 3 and 4, a water level detection system 170 that may be used within washing machine appliance 100 will be described according to an exemplary embodiment. Specifically, FIGS. 3 and 4 provide rear perspective and side perspective views, respectively, of water level detection system 170 operably coupled to a drain pump assembly (e.g., drain assembly 144). However, water level detection system 170 as described herein is only one exemplary configuration used for the purpose of explaining aspects of the present subject matter and is not intended to limit the scope of the invention in any manner.

As illustrated, sump 142 defines a drain basin at a lowest point of wash tub 124 for collecting wash fluid under the force of gravity. A sump hose 172 extends between sump 142 and an intake 174 of drain pump 146. According to the illustrated embodiment, drain pump 146 is a positive displacement pump configured for urging wash fluid that collects in sump 142 and sump hose 172 through a pump discharge 176, through drain hose 150, and to external drain 148. However, it should be appreciated that the drain assembly 144 and the sump drainage configuration illustrated herein are only exemplary and not intended to limit the scope of the present subject matter. For example, drain pump 146 may have a different configuration or position, may include one or more filtering mechanisms, etc.

Water level detection system 170 may generally include an air chamber 180 that extends from sump hose 172 (or another suitable portion of sump 142) at least partially upward along the vertical direction V. A pressure hose 182 is fluidly coupled to a top end 184 of air chamber 180 and extends to a pressure sensor 186. In general, pressure sensor 186 may be any sensor suitable for determining a water level within sump 142 based on pressure readings. For example, pressure sensor 186 may be a piezoelectric pressure sensor and thus may include an elastically deformable plate and a piezoresistor mounted on the elastically deformable plate. According to exemplary embodiments, pressure sensor 186 is positioned proximate top 104 of cabinet 102, e.g., proximate or mounted to control panel 160. Thus, pressure hose 182 extends from air chamber 180 (i.e., proximate bottom 106 of cabinet 102) upward along the vertical direction V to pressure sensor 186.

Water level detection system 170 and pressure sensor 186 generally operate by measuring a pressure of air within air chamber 180 and using the measured chamber pressure to estimate the water level in sump 142. For example, when the water level within sump 142 falls below a chamber inlet 188, the pressure within air chamber 180 normalizes to ambient or atmospheric pressure, and thus reads a zero pressure. However, when water is present in sump 142 and rises above chamber inlet 188, the measured air pressure becomes positive and may increase proportionally with the water level. Although sump 142 is described herein as containing water, it should be appreciated that aspects of the present subject matter may be used for detecting the level of any other suitable wash fluid.

As explained briefly above, during a drain cycle of washing machine appliance 100, drain assembly 144 discharges wash fluid (identified herein generally by reference numeral 190) collected within sump 142 through drain hose 150 and out of external drain 148 into standpipe 152. Notably, when wash fluid 190 is emptied from sump 142 such that drain pump 146 has no more wash fluid to pump, the pump can no longer force wash fluid 190 through the drain hose 150 and the drain cycle ends. However, wash fluid 190 remains within drain hose 150. Specifically, for example, a column of wash fluid 190 may remain within a drain hose 150 between pump discharge 176 and external drain 148. Thus, when drain pump 146 is turned off, this residual wash fluid may flow back into sump 142. Notably, standpipes 152 with an inlet that is high relative to pump discharge 176 may result in more wash fluid 190 flowing back into sump 142, e.g., relative to shorter or lower standpipes or external drains. In order to precisely fill sump 142 and properly regulate various control algorithms, it may be desirable to know whether a standpipe 152 or external drain 148 is considered "elevated." Aspects of the present subject matter are directed towards systems and methods of determining whether a standpipe 152 or external drain 148 is elevated such that controller 166 may compensate for the excess wash fluid 190 that backflows into sump 142 after a drain cycle.

As described herein, standpipe 152 and external drain 148 are described as either being "elevated," in which case controller 166 makes appropriate compensations, or "standard" or "not elevated," in which case controller 166 may operate normally. Although this binary decision is described herein for simplicity, it should be appreciated that controller 166 and the methods described herein may be used form a more complex and precise residual wash fluid detection method and make incremental performance and operational changes in response. The exemplary volume thresholds, time thresholds, and method steps described herein are intended only to explain aspects of the present subject matter and are not intended to limit the scope of the present disclosure.

Now that the construction of washing machine appliance 100 and the configuration of controller 166 according to exemplary embodiments have been presented, an exemplary method 200 of operating a washing machine appliance will be described. Although the discussion below refers to the exemplary method 200 of operating washing machine appliance 100, one skilled in the art will appreciate that the exemplary method 200 is applicable to the operation of a variety of other washing machine appliances, such as vertical axis washing machine appliances. In exemplary embodiments, the various method steps as disclosed herein may be performed by controller 166 or a separate, dedicated controller.

Figure 5:
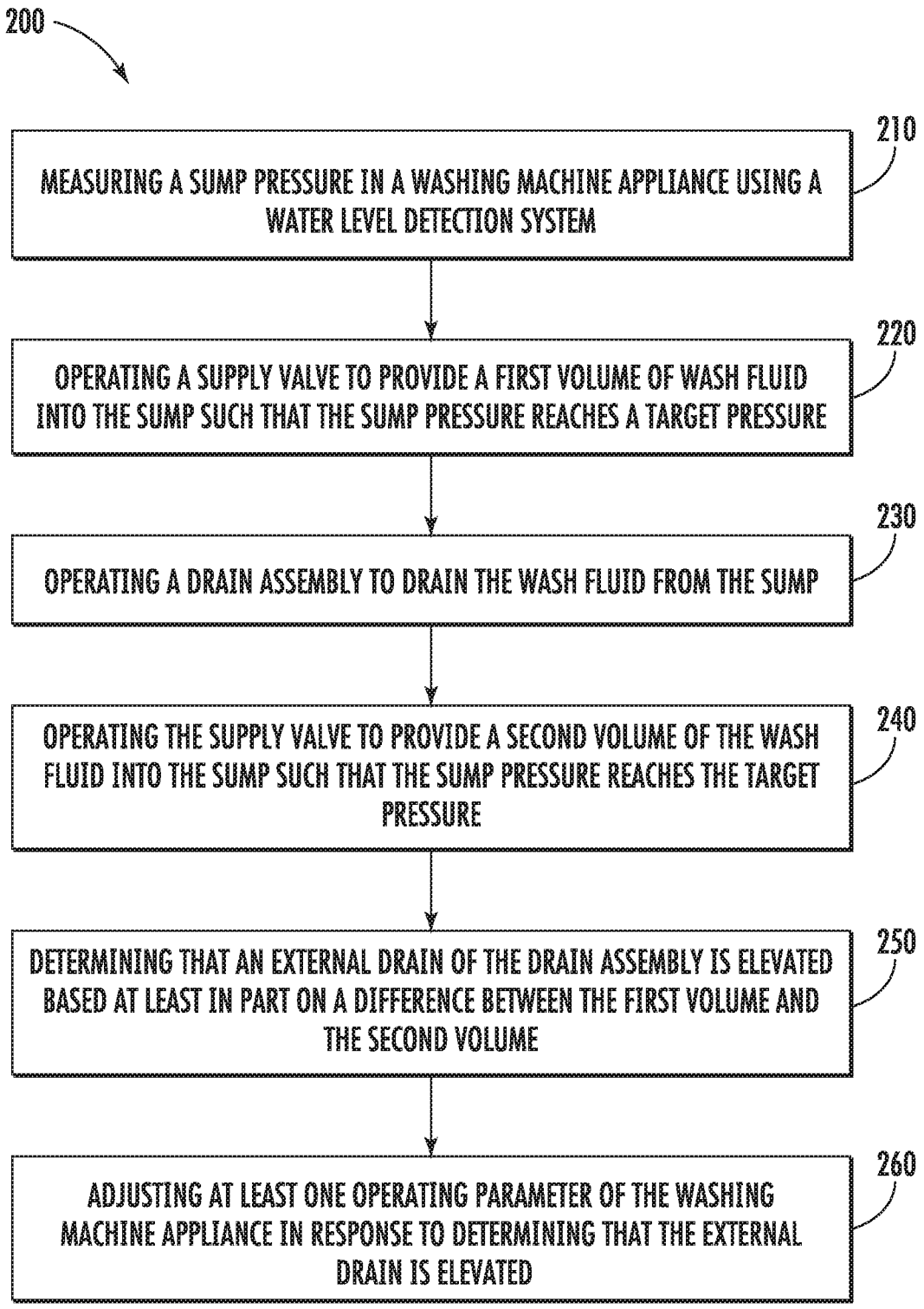
FIG. 5 illustrates a method for controlling a washing machine appliance in accordance with one embodiment of the present disclosure.

Referring now to FIG. 5, method 200 includes, at step 210, measuring a sump pressure in a washing machine appliance using a water level detection system. In this regard, continuing the example from above, water level detection system 170 may be used to monitor a volume, weight, and/or height of wash fluid 190 within sump 142. Specifically, during a fill cycle, water level detection system 170 may be used to periodically or continuously monitor sump pressures at any suitable frequency and for any suitable duration. These sump pressures may be used directly as representative of the amount of wash fluid within sump 142, or may be converted using any suitable mathematical transformation to represent volumes, liquid heights, etc. As explained in further detail below, these sump pressure measurements may thereafter be used to facilitate improved operation of washing machine appliance 100, e.g., by facilitating more precise fill volumes, improving control algorithms, etc.

It should be appreciated that sump pressures may be correlated to the volume or level of water or wash fluid within sump 142, e.g., as mentioned above. Furthermore, it should be appreciated that as used herein, the terms volume, level, height, weight, and similar terms may be used interchangeably to refer to the amount of wash fluid within sump 142. For example, other proxies, substitutes, or parameters may be indicative of these volumes while remaining within scope of the present subject matter, such as a target weight of water, a target fill level or height, or a water pressure generated at pressure sensor 186 by the wash fluid in wash tub 124. It should be appreciated that controller 166 may be programmed with algorithms or transfer functions for correlating such parameters as is known in the art.

Step 220 includes operating a supply valve to provide a first volume of wash fluid into the sump such that the sump pressure reaches a target pressure. Thus, controller 166 may operate a supply valve to provide a flow of wash fluid into a sump of a washing machine appliance until a target pressure or volume is reached. In this regard, continuing the example from above, water supply valve 158 may be opened to direct water from water supply 155 directly into wash tub 124. According to an exemplary embodiment, water may be provided into or through detergent drawer 156 where the water may mix with detergent to form wash fluid that flows into sump 142. It should be appreciated that the terms water, wash fluid, and the like may be used interchangeably herein.

As used herein, the term "first volume" is generally intended to refer to the amount of water or wash fluid that controller 166 determines has been dispensed into sump 142 when there is no wash fluid in sump 142, minimal wash fluid in sump 142, no clothes in wash basket 120, or otherwise when drain hose 150 is not filled with residual wash fluid. Thus, according to an exemplary embodiment, controller 166 may be configured to determine that the wash basket 120 is empty before providing the first volume of wash fluid into the sump, or to determine that there is no wash fluid within sump 142 or drain hose 150. For example, the first volume may be the estimated volume of dispensed water during the first fill cycle of a new appliance or upon reinstalling washing machine appliance 100. In this regard, as will be explained in more detail below, the first volume is measured or determined prior to dispensing wash fluid into sump 142 so that the dispensed first volume may be used as a standard for determining how much residual wash fluid is within drain hose 150 after it is installed in standpipe 152.

In addition, as used herein, the term "target pressure" may be any suitable pressure detected by water level detection system 170 that may be used to facilitating improved fill process. For example, the target pressure may be arbitrarily selected to provide a known wash fluid level within sump 142. For example, as explained above, when the level of wash fluid 190 within sump 142 is below chamber inlet 188, the pressure within air chamber 180 normalizes to ambient or atmospheric pressure, and thus reads a zero pressure. However, when wash fluid 190 rises above chamber inlet 188, the measured air pressure becomes positive and may increase proportionally with the water level. Thus, according to an exemplary embodiment, the target pressure may be a first non-zero pressure measurement detected by water level detection system 170. Thus, as soon as the measured pressure detected by pressure sensor 186 varies from zero, controller 166 may know that the water level has breached a known volume within sump, e.g., corresponding to the height of chamber inlet 188. According to still other embodiments other target pressures may be used. For example, the supply valve 158 may be opened for some arbitrary amount of time and the "target pressure" may be set as the pressure after the target valve open time has been reached and the supply valve 158 has been closed.

According to an exemplary embodiment, the fill volumes, water levels, and flow rates through water supply valve 158, and other wash fluid parameters may be approximated based on factors such as supply water pressure, valve model or configuration, empirical data, theoretical data, flow models, or any other suitable factors. For example, water supply valve 158 may be a fixed flow valve that provides a relatively constant flow rate of wash fluid when water supply 155 is maintained at a suitably high pressure, e.g., such as in the case of a municipal water supply. Thus, by knowing when water supply valve 158 is open and closed along with the flow rate of wash fluid from water supply valve 158, controller 166 may calculate the amount or volume of fluid dispensed and determine a target time that the water supply valve 158 should be opened to supply the target volume of wash fluid.

Step 230 includes operating a drain assembly to drain the wash fluid from the sump. In this regard, continuing example from above, drain pump 146 and drain assembly 144 may be selectively operated to urge wash fluid 190 from sump 142, through drain hose 150, through external drain 148, and into standpipe 152. A drain cycle typically ceases when drain pump 146 is no longer able to discharge wash fluid 190 through external drain 148, e.g., when drain pump 146 runs out of wash fluid to pump and starts drawing in air. Notably, after the drain cycle ends and drain pump 146 is turned off, the residual wash fluid contained within drain hose 150, e.g., between pump discharge 176 and external drain 148, flows back into sump 142. Notably, for installations with higher external drains 148 or standpipes 152, more residual wash fluid flows back into sump 142 and may affect subsequent fill cycles. Steps 240 through 260 are designed to compensate for such residual wash fluid.

Step 240 includes operating the supply valve to provide a second volume of the wash fluid into the sump such that the sump pressure reaches the target pressure. Notably, higher volumes of residual wash water from the first fill cycle will result in a lower second volume and a larger difference between the first volume and the second volume. Thus, step 250 includes determining that an external drain of the drain assembly is elevated based at least in part on a difference between the first volume and the second volume. Notably, as described in more detail below, if an external drain is deemed elevated or nonstandard, controller 166 may take corrective action to improve wash performance or conserve water.

According to an exemplary embodiment, determining that the external drain is elevated based at least in part on the difference between the first volume and the second volume may involve comparing a valve open time for dispensing the first volume and the second volume. In this regard, during the first fill cycle, controller 166 may monitor or measure a first time that supply valve 158 is open to provide the first volume such that the sump pressure reaches the target pressure. Subsequently, during the second fill cycle, controller 166 may measure a second time that the supply valve 158 is open to provide the second volume such that the sump pressure reaches the target pressure. By comparing the first time and the second time, controller 166 may be programmed to make a determination as to whether or to what extent external drain 148 is elevated and take appropriate corrective action.

For example, an external drain may be deemed "elevated" if a difference between the first time and the second time exceeds a predetermined time threshold. For example, the predetermined time threshold may be between about 0.5 seconds and 1 minute, between about 1 second and 45 seconds, between about 5 seconds and 30 seconds, or between about 10 seconds and 20 seconds. Other suitable time thresholds are possible and within scope the present subject matter.

According to another exemplary embodiment, determining that the external drain is elevated based at least in part on a difference from first volume and the second volume may involve comparing the volumes or their corresponding pressures directly. For example, an external drain may be deemed "elevated" if it is determined that the difference between the first volume and the second volume exceeds a predetermined volume threshold. According to an exemplary embodiment, this predetermined volume threshold may be between about 0.1 in 1 gallons, between about 0.2 and 0.7 gallons, between about 0.3 and 0.5 gallons, or any other suitable volume threshold. Notably, according to exemplary embodiment, the difference between the first volume and the second volume corresponds at least partially with the amount of residual wash fluid that flows back into sump 142. The predetermined volume threshold may be set accordingly based on the particular application, machine size, etc.

Step 260 includes adjusting at least one operating parameter of the washing machine appliance in response to determining that the external drain is elevated. As used herein, an "operating parameter" of washing machine appliance 100 is any cycle setting, operating time, component setting, spin speed, part configuration, or other operating characteristic that may affect the performance of washing machine appliance 100. Thus, references to operating parameter adjustments or "adjusting at least one operating parameter" are intended to refer to control actions intended to improve system performance based at least in part on the height of an external drain or other system parameters.

For example, adjusting an operating parameter may include decreasing a fill volume of a subsequent fill cycle to compensate for residual wash fluid that fails to discharge from the drain hose 150. In addition, adjusting an operating parameter may include manipulating at least one of a cloth type detection algorithm, a load size detection algorithm, or a spin cycle or speed of washing machine appliance 100. Other operating parameter adjustments are possible and within the scope of the present subject matter.

FIG. 5 depicts steps performed in a particular order for purposes of illustration and discussion. Those of ordinary skill in the art, using the disclosures provided herein, will understand that the steps of any of the methods discussed herein can be adapted, rearranged, expanded, omitted, or modified in various ways without deviating from the scope of the present disclosure. Moreover, although aspects of method 200 are explained using washing machine appliance 100 as an example, it should be appreciated that these methods may be applied to the operation of any suitable washing machine appliance.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance comprising:

a sump for collecting wash fluid;

a supply valve for providing the wash fluid into the sump;

a drain assembly comprising a drain hose that fluidly couples the sump to an external drain for discharging the wash fluid through the external drain;

a water level detection system comprising a pressure sensor fluidly coupled to the sump; and a controller operably coupled to the supply valve, the drain assembly, and the water level detection system, the controller being configured to:

measure a sump pressure using the water level detection system;

operate the supply valve to provide a first volume of the wash fluid into the sump such that the sump pressure reaches a target pressure;

operate the drain assembly to drain the wash fluid from the sump;

operate the supply valve to provide a second volume of the wash fluid into the sump such that the sump pressure reaches the target pressure;

determine that the external drain is elevated based at least in part on a difference between the first volume and the second volume; and adjust at least one operating parameter of the washing machine appliance in response to determining that the external drain is elevated, wherein adjusting the at least one operating parameter of the washing machine appliance comprises decreasing a fill volume of a subsequent fill cycle to compensate for residual wash fluid that fails to discharge from the drain hose.

2. The washing machine appliance of claim 1, wherein operating the supply valve to provide the first volume of the wash fluid into the sump is performed during an installation procedure or when there is no wash fluid in the washing machine appliance.

3. The washing machine appliance of claim 1, wherein the controller is further configured to:

determine that the wash basket is empty before providing the first volume of wash fluid into the sump.

4. The washing machine appliance of claim 1, wherein the target pressure is a first non-zero pressure measurement detected by the water level detection system.

5. The washing machine appliance of claim 1, wherein operating the supply valve to provide the first volume of the wash fluid comprises:

opening the supply valve for a predetermined fill time, the target pressure being measured by the water level detection system at the end of the predetermined fill time.

6. The washing machine appliance of claim 1, wherein determining that the external drain is elevated based at least in part on the difference between the first volume and the second volume comprises:

measuring a first time that the supply valve is open to provide the first volume to reach the target pressure;

measuring a second time that the supply valve is open to provide the second volume to reach the target pressure; and determining that a difference between the first time and the second time exceeds a predetermined time threshold.

7. The washing machine appliance of claim 6, wherein the predetermined time threshold is between 5 and 30 seconds.

8. The washing machine appliance of claim 1, wherein determining that the external drain is elevated based at least in part on the difference between the first volume and the second volume comprises:

determining that the difference between the first volume and the second volume exceeds a predetermined volume threshold.

9. The washing machine appliance of claim 8, wherein the predetermined volume threshold is 0.3 gallons.

10. The washing machine appliance of claim 1, wherein adjusting the at least one operating parameter of the washing machine appliance comprises:

manipulating at least one of a cloth type detection algorithm, a load size detection algorithm, or a spin cycle of the washing machine appliance.

11. The washing machine appliance of claim 1, wherein the controller is further configured to determine the first volume and the second volume by:

obtaining a flow rate of a flow of the wash fluid into the sump; and determining the first volume and the second volume by multiplying the flow rate by an amount of time that the supply valve is opened.

12. A method for operating a washing machine appliance, the washing machine appliance comprising a sump for collecting wash fluid, a supply valve for providing the wash fluid into the sump, a drain assembly comprising a drain hose for discharging the wash fluid through an external drain, and a water level detection system for measuring a sump pressure, the method comprising:

measuring a sump pressure using the water level detection system;

operating the supply valve to provide a first volume of the wash fluid into the sump such that the sump pressure reaches a target pressure;

operating the drain assembly to drain the wash fluid from the sump;

operating the supply valve to provide a second volume of the wash fluid into the sump such that the sump pressure reaches the target pressure;

determining that the external drain is elevated based at least in part on a difference between the first volume and the second volume; and adjusting at least one operating parameter of the washing machine appliance in response to determining that the external drain is elevated, wherein adjusting the at least one operating parameter of the washing machine appliance comprises decreasing a fill volume of a subsequent fill cycle to compensate for residual wash fluid that fails to discharge from the drain hose.

13. The method of claim 12, wherein operating the supply valve to provide the first volume of the wash fluid into the sump is performed during an installation procedure or when there is no wash fluid in the washing machine appliance.

14. The method of claim 12, wherein determining that the external drain is elevated based at least in part on the difference between the first volume and the second volume comprises:

measuring a first time that the supply valve is open to provide the first volume to reach the target pressure;

measuring a second time that the supply valve is open to provide the second volume to reach the target pressure; and determining that a difference between the first time and the second time exceeds a predetermined time threshold.

15. The method of claim 12, wherein determining that the external drain is elevated based at least in part on the difference between the first volume and the second volume comprises:

determining that the difference between the first volume and the second volume exceeds a predetermined volume threshold.

16. The method of claim 12, wherein adjusting the at least one operating parameter of the washing machine appliance comprises:

manipulating at least one of a cloth type detection algorithm, a load size detection algorithm, or a spin cycle of the washing machine appliance.

* * * * *